US005381902A

United States Patent [19]

Dumser et al.

[11] Patent Number: 5,381,902

[45] Date of Patent: Jan. 17, 1995

[54] DEVICE FOR SUPPLYING A CIRCUIT OF A HEATING OR COOLING SUPPLY SYSTEM

[75] Inventors: Josef Dumser, Landau; Karl H. Kolaska, Löwenstein, both of Germany

[73] Assignees: Dumser Metallbau GmbH, Landau; Storopack Hans Reichenecker GmbH & Co., Metzingen, both of Germany

[21] Appl. No.: 34,356

[22] Filed: Mar. 19, 1993

[30] Foreign Application Priority Data

Mar. 19, 1992 [DE] Germany ..... 9203601[U]
Sep. 18, 1992 [EP] European Pat. Off. ..... 92116004

[51] Int. Cl.[6] ..... B65D 81/02; F16L 59/16; H02G 3/08

[52] U.S. Cl. ..... 206/523; 137/377; 165/11.1; 220/3.3; 220/3.94; 220/4.21; 237/56

[58] Field of Search ..... 137/375, 377, 382; 165/11.1; 237/8 R, 56; 220/484, 3.2, 3.3, 3.94, 4.21; 206/216, 523, 521

[56] References Cited

U.S. PATENT DOCUMENTS

| | | | |
|---|---|---|---|
| 2,803,368 | 8/1957 | Koch | 220/4.21 |
| 3,136,442 | 6/1964 | Massey | 220/3.94 X |
| 3,250,297 | 5/1966 | Mooneyham | 137/375 X |
| 3,403,713 | 10/1968 | Good et al. | 220/4.21 X |
| 4,449,554 | 5/1984 | Busse | 137/375 X |
| 4,708,162 | 11/1987 | Bayat | 137/382 |
| 4,716,926 | 1/1988 | Jacobs | 137/375 |
| 4,802,502 | 2/1989 | Williams | 137/382 |
| 4,872,575 | 10/1989 | Kobilan | 220/33 |
| 5,193,574 | 3/1993 | Loper | 137/382 |
| 5,253,670 | 10/1993 | Perrott | 137/561 A X |

FOREIGN PATENT DOCUMENTS 3207372 9/1983 Germany .
3416574 11/1984 Germany .

OTHER PUBLICATIONS

"Montreren statt installieren-Vorgefertigte Waemeleit-zentrale spart Lohnstunden am Bau", sh-technik, 1986, Heft 5, pp. 218-219.

*Primary Examiner*—Bryon P. Gehman
*Attorney, Agent, or Firm*—Cohen, Pontani, Lieberman, Pavane

[57] ABSTRACT

Units for supplying a circuit of a heating or cooling supply system which are required for conveying a medium and for regulating and monitoring are arranged at parallel pipelines for the forward and return flows so as to be combined in an installation-ready structural component group in a housing of thermal insulating plastic, the housing being divided into a lower shell and an upper shell by a seam extending approximately in the central plane formed by the pipelines, the lower shell and the upper shell having a lock-seam connection with lock-seams that form a positive-locking connection along the entire outer edges of the shells, the upper shell being provided with openings that allow the parts of the units essential for operation to penetrate, while the lower shell is provided with a component for direct fastening to a wall, the strength and thickness of the material of the lower shell and upper shell being selected so that the housing can be used as protective transportation packing for the structural component group and as thermal insulating sheathing after assembly.

12 Claims, 7 Drawing Sheets

DEVICE FOR SUPPLYING A CIRCUIT OF A HEATING OR COOLING SUPPLY SYSTEM

BACKGROUND OF THE INVENTION

The invention is directed to a device for supplying a circuit of a heating or cooling supply system having a structural component group made up of various units for conveying a medium and for regulating and monitoring the medium, including fittings and connecting parts, which units are combined in parallel pipelines for forward and return flow of the medium. The component group then being arranged in a housing.

When installing heating systems, units required for conveying the heat carrier medium and for regulating and monitoring must be provided for each circuit, particularly when the heating system includes a plurality of circuits, e.g. a hot water heating system, a floor heating system, as well as a utility water preparation system and possibly even solar heating.

In order to facilitate the formerly conventional, very labor-intensive peripheral installation of these units and their pipelines in connection to a heating boiler, it is already known to combine the units required for a circuit, e.g. circulating pumps, regulators, mixers, safety and shut-off members, and display and operating members, in a compact housing in a preassembled installation unit in the factory (DE-Z "sh-technik", 1986, No. 5, pages 218, 219).

It is also already known to provide a modular control and pump unit mounted in a cabinet container with thermal insulation (DE-A 34 16 574). This thermal insulation includes plates which are built onto a supporting frame inside the cabinet container. Finally, in the case of a distributor in which the units are integrated in square hollow columns which are combined to form a panel, it is also no longer novel to provide the latter with a thermal insulation layer which is formed by a U-shaped shell and a plate and adapted to their body (DE-A 32 07 372).

SUMMARY OF THE INVENTION

With this background in mind, the object of the present invention is to provide a device of the above-mentioned type which enables the best possible thermal insulation also in the region of the individual units while requiring as little space as possible and with a reduced cost for assembly.

Pursuant to this object and others which will become apparent hereafter, one aspect of the present invention resides in the housing being made of a thermal insulating plastic material and divided by a seam into an upper shell and a lower shell. The shells are provided on their entire outer edges with a positive-locking construction for connecting the shells together. The upper shell is provided with openings that allow components of the units that require access for operation to pass through. The material of the housing is selected to have a strength and thickness so that the housing is both a protective transportation package and a thermal insulating sheeting for the structural component group.

The advantage of the invention chiefly consists in a further economizing on time and material compared to the prior art with respect to the shipping, sale and assembly of preassembled installation units of the type indicated. The construction of the housing from a lower shell and an upper shell of thermal insulating plastic of suitable strength with undercut lock-seam or fold connections at the edges allows repeated positive-locking closing and opening of the housing. As is known per se in plastic foam packing, hollow spaces are formed in the interior region of the shells by depressions which correspond in shape and size to the respective structural component group and in which the structural component groups can be inserted so as to be circumferentially enclosed to a great extent. The structural component groups are accordingly enclosed by the thermal insulating material in such a way that they are not only protected against heat losses during operation, but are also protected against shifting so that the closed housing can simultaneously serve as transportation packing. Thus, as a result of the lock-seam connection, it is possible to open and close the housing as desired, first when preparing for shipping in the factory, then during assembly, and finally for maintenance or repair at the heating installation.

Since the structural component groups, including their individual units, must be enclosed by the housing during transportation, but may not project beyond the housing, and whereas on the other hand individual units, e.g. pumps, generate heat during operation and may therefore not be completely enveloped by thermal insulating material, depressions can be provided in the outer surfaces of the upper shell so as to free these units at least in some areas. These depressions are advisably constructed as ducts running parallel to the pipeline making up the units so that air can circulate around the heat-generating units in the manner of a convection of rising air.

The shells can also be divided again, and divided along a plane extending at a right angle to the central plane running through the pipelines, so that they can be placed on the structural component group laterally.

Expandable polypropylene (EPP) is preferably used as the work material fop the shells, but it is also possible to use other work materials such as polyethylene, expandable polystyrene (EPS), also in modified form ("Dytherm"), or polyurethane. The shape and dimensions of the undercut lock-seams at the edges of the shells must be selected on the basis of the strength and elastic properties of the thermal insulating material so that the lock-seam connections can snap in by pressing down lightly on the upper shell accompanied by elastic deformation, but also so that the resilient restoring force inherent to the material is great enough to keep the lock-seam connection closed even after repeated opening and closing. Centering pins which are arranged in the interior region of the shells and engage in corresponding receptacles, possibly also so as to snap in, serve to facilitate the assembly of the shells and to hold them together.

Openings are provided in the edge regions of the shells allowing pipe connections to pass through. The openings are advisably constructed so that the thermal insulation of the pipelines can also adjoin the thermal insulating material of the shells without cold bridges. Openings are also provided in the upper shell of the housing so that parts essential to the operation of the installation such as pumps, shut-off valves, thermometers and manometers can project through to the outside so as to be visible and serviceable. In so doing, it must be ensured that the openings correspond to the operating members so that the upper shell can be removed or attached without disassembling individual parts.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
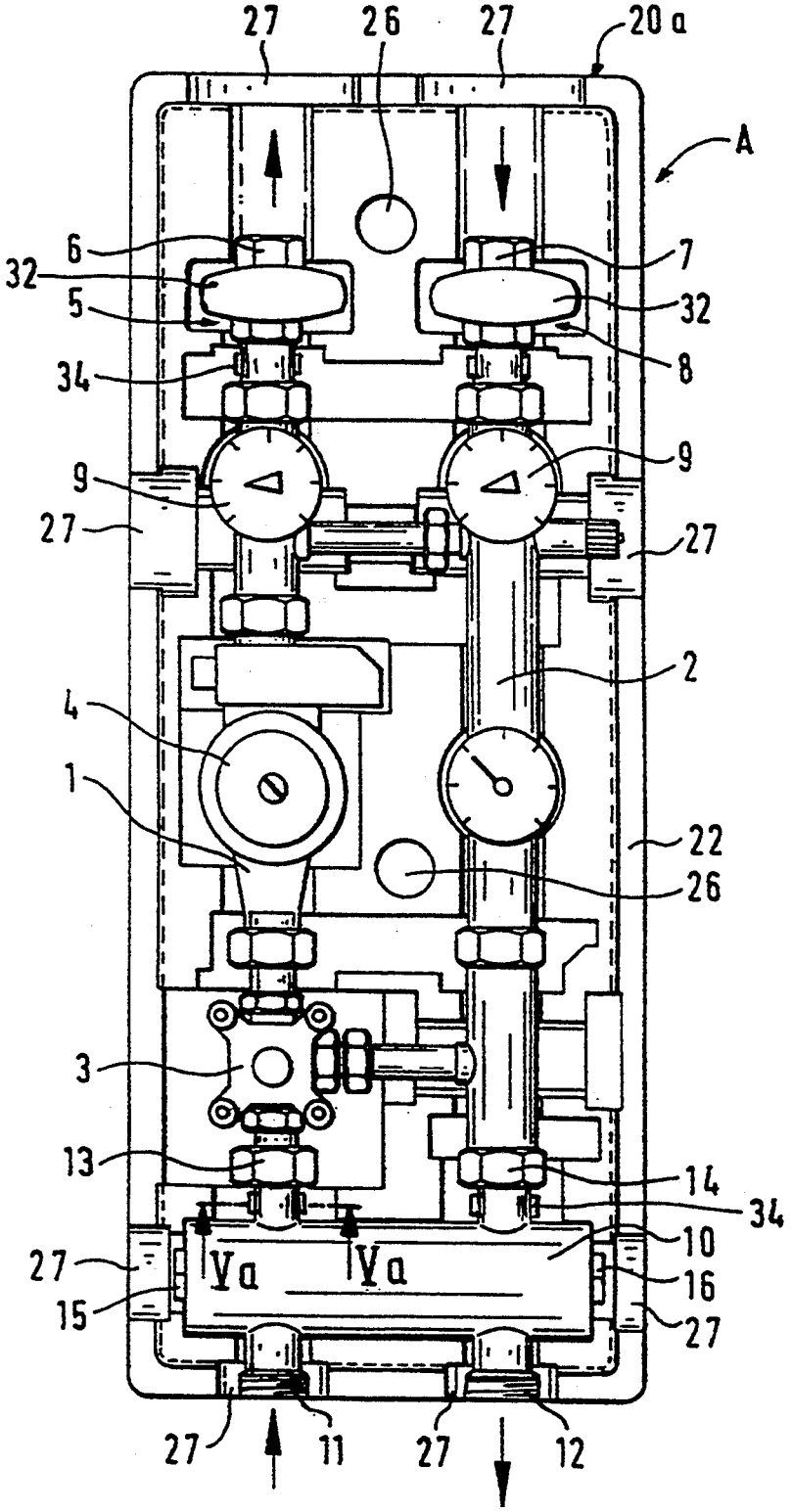
FIG. 1 shows a top view of a structural component group inserted in a lower shell of the housing with the upper shell removed, pursuant to the present invention.
Figure 2:
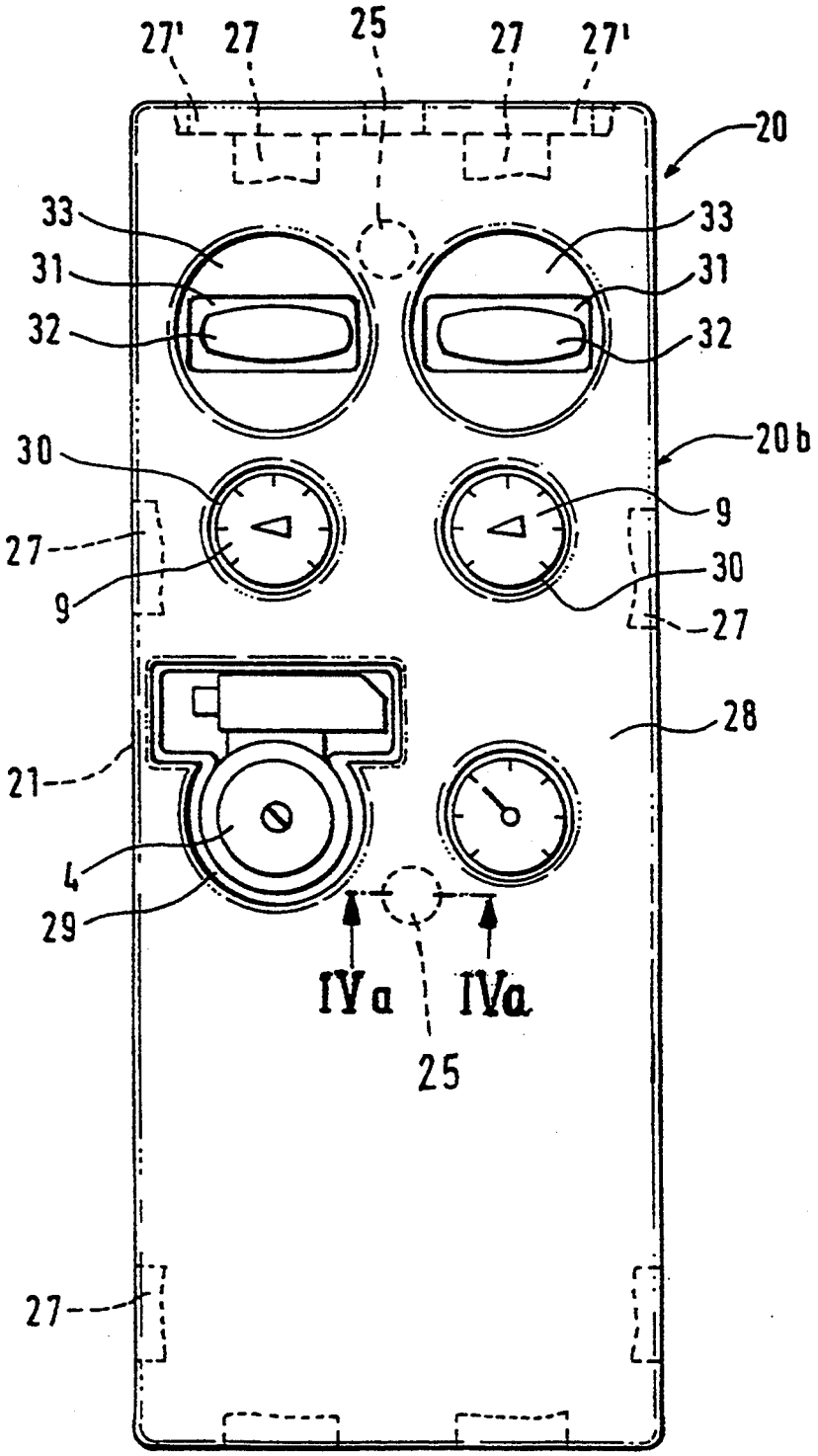
FIG. 2 shows a top view of the upper shell in a closed housing.

FIGS. 1 and 2 show an embodiment of a structural component group A which can be used as a regulating system for a sliding heating circuit regulating means with three-way mixers and a servodrive. Two pipelines 1 and 2 for forward and return flow are arranged parallel to one another and close together. In the forward flow direction, the forward flow pipeline 1 includes first a three-way mixer 3, followed by a pump 4 and a ball valve 8 on the network side which is conventionally outfitted with gravity brakes. The connection to the network of the heating circuit on the forward flow side is indicated by the number 6. The return flow from the network includes a corresponding connection 7 and a ball valve 8. Thermometers 9 are assigned to both pipelines 1 and 2.

The structural component group A shown in FIG. 1 also includes a distributor system having a heating circuit distributor 10 which has a connection 11 on the forward flow side and a connection 12 on the return flow side to the boiler. Corresponding connections 13 and 14 are provided for the forward flow pipeline 1 and the return flow pipeline 2. The distributor 10 has a connection 18 at the front for a safety group D (FIG. 6) as well as a connection 16 for a pressure compensation tank, not shown.

The structural component group A is enclosed by a housing 20 which includes two shells, a lower shell 20*a* and an upper shell 20*b*. The two shells 20*a* and 20*b* are produced from a thermal insulating material of suitable strength and thickness, advisably plastic foam, particularly polypropylene. Both the lower shell 20*a* and the upper shell 20*b* have receptacles at the insides which are not shown for the sake of clarity. These receptacles imitate the shape of the pipelines 1 and 2 and other units as far as possible so that the metallic parts are enclosed as closely as possible by the thermal insulating material.

Figure 3B:
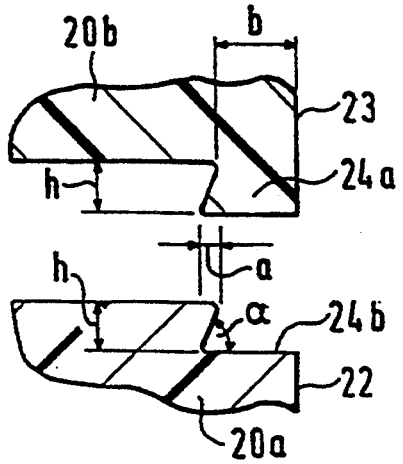
FIGS. 3*a* and 3*b* are enlarged views showing sections through the lock-seam construction in the closed and opened states.
Figure 3A:
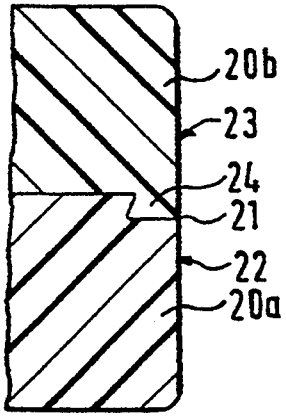

The parting line 21 between the two shells 20*a* and 20*b* extends approximately in the central plane of the structural component group so that the shells 20*a* and 20*b* can be plugged together by means of a lock-seam connection 24 provided along the edges 22, 23 of the shells (FIG. 3*a*). As can be seen from FIG. 3*b*, which shows the lock-seam connection 24 as it appears shortly before closing, an undercut lock-seam strip 24*a* is arranged at the edge 23 of the upper shell 20*b* and an undercut groove 24*b* is arranged at the edge 22 of the lower shell 20*a*. The width b of the lock-seam strip 24*a* at the narrowest point and its height h as well as the angle of inclination $\alpha$ of the undercut and the resulting distance a between the lock-seam edges, are dimensioned in such a way that a snap-in effect can be achieved depending on the elasticity of the utilized material.

Aside from this simple lock-seam construction, it is also possible to provide a dovetailed construction which prevents a possible deformation of the shell itself when snapping in and achieves a more reliable locking in the snapped in state.

Figure 4A:
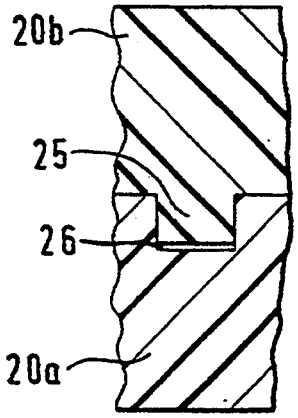
FIGS. 4*a* to 4*c* show sections through different embodiments of the centering pin.
Figure 4B:
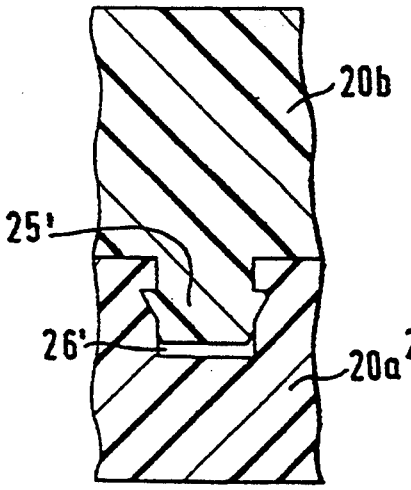
Figure 4C:
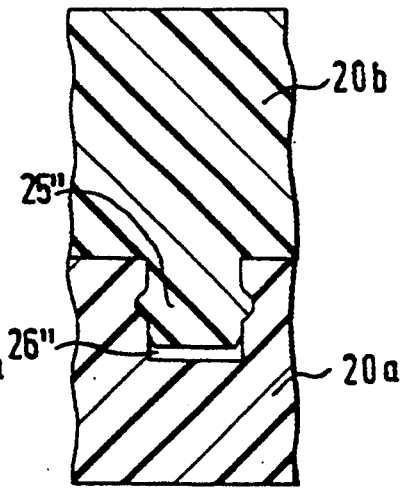

Centering pins 25 which fit into corresponding recesses 26 in the lower shell 20*a* are provided in the interior region at a shell, e.g. in the upper shell 20*b* (FIG. 4*a*), to facilitate the plugging together of the two shells. To facilitate the centering, the centering pins (25) can be constructed conically at least at their outer ends. To achieve a certain locking effect also in the region of the centering pins 25, a dovetailed toothing can be provided between the centering pins 25′ and the recess 26′ (FIG. 4*b*) or a flange-shaped enlargement can be provided at the centering pin 25″ which fits into a corresponding annular groove in the recess 26″ (FIG. 4*c*).

Cut out portions 27 are provided in the region of the edge 22 of the lower shell 20*a* and the edge 23 of the upper shell 20*b* so as to allow the pipelines and units which are to be connected to pass through. These cut out portions 27 are constructed in this way where necessary and enclosed by a recess 27′ (FIG. 2) so that the thermal insulating casing or jacket of the pipelines to be connected are tightly bound in and the connecting points are concealed.

The upper shell 20*b* has a number of openings in its front side 28 to allow the parts of the units and operating elements which are essential to the operation of the structural component group to pass through. In particular, they include opening 29 for the pump 4, two openings 30 for the thermometers 9, and two elongated openings 31 for the handles 32 of the ball valves 5 and 8, respectively. The dimensions of the upper shell 20*b* are selected so that the surfaces of the thermometers 9 and the handles 32 lie approximately in the surface plane of the upper shell 20*b*. Depressions 33 are provided in the region of the handles 32 so that the handles can be turned. The housing of the pump 4 must project somewhat beyond the surface of the upper shell 20*b* in the completely assembled state to carry off the heat developed during operation of the pump by means of convection and to prevent a build-up of heat.

Figure 5A:
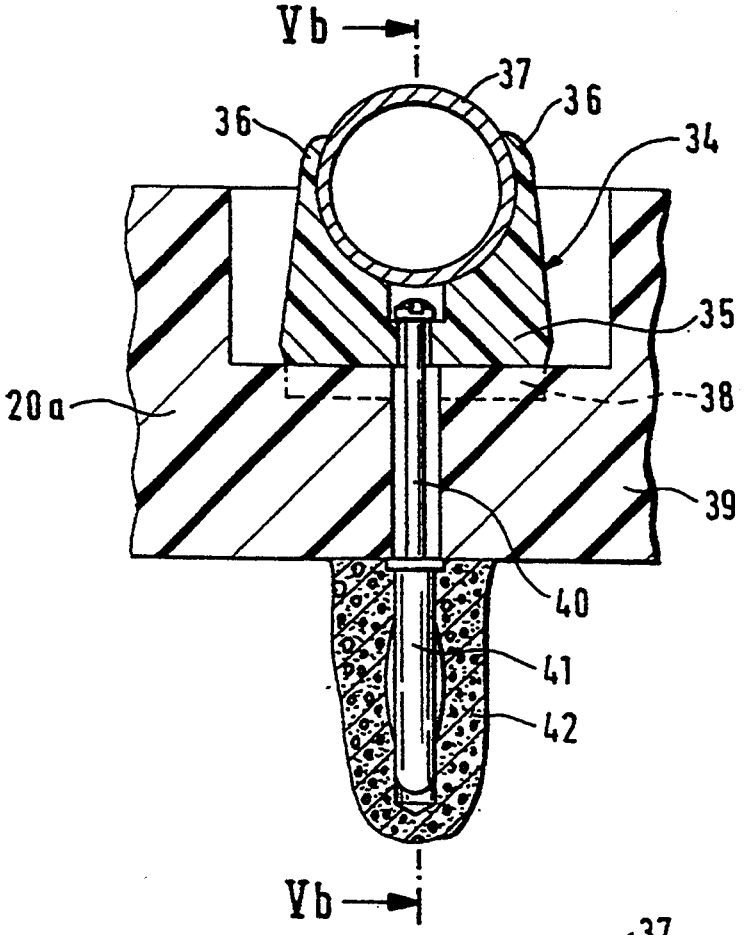
FIGS. 5*a* and 5*b* show sections through a clip provided at the lower shell for direct fastening to a wall.
Figure 5B:
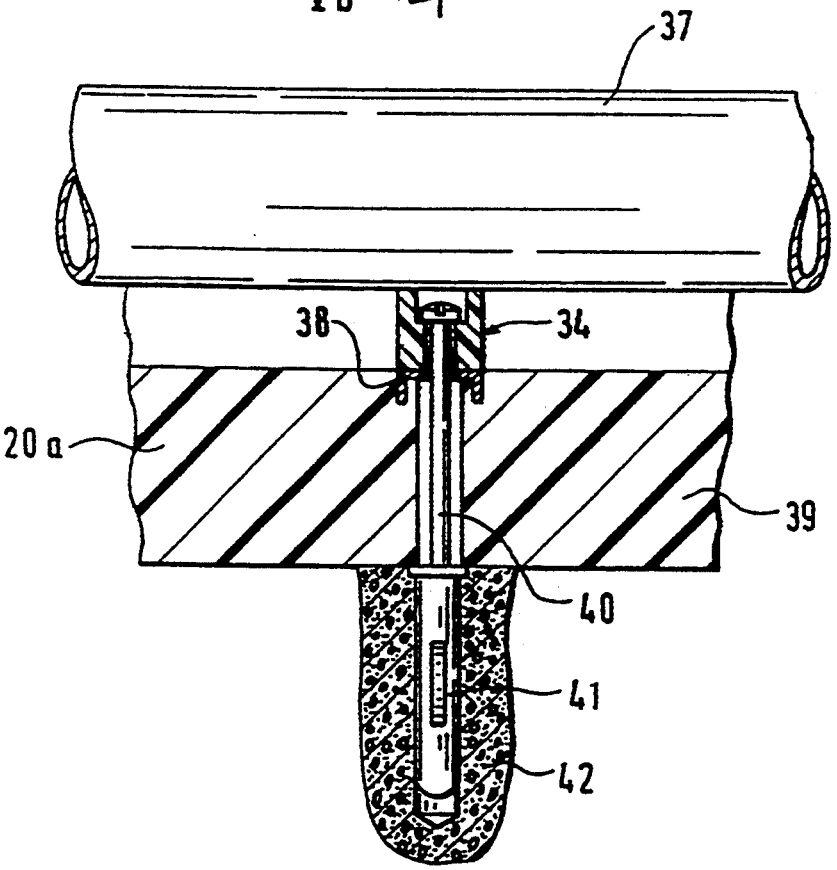

The lower shell 20*a* is designed for fastening directly to a wall. Pipe clamping clips 34, which are only suggested in FIG. 1 and are shown in enlarged scale in FIGS. 5*a* and 5*b*, are provided for this purpose. The pipe clips 34 are advisably made of plastic and have an approximately U-shaped cross section with a solid base part 35 and two projecting legs 36 which are adapted to the shape of the pipe 37 and enclose the latter up to and beyond its greatest diameter in a clamping manner. The base part 35 contacts the bottom 39 of the lower shell 20*a* via a stabilizing rail 38 of metal with a U-shaped cross section. The lower portion of the rail 38 presses into the material of the bottom part 39 with its downward opening section. A fastening screw 40 which is screwed against the building wall 42 via a dowel 41 in a manner known per se extends through the base part 35. In this way, the wall fastening of the lower shell with the structural component group A can not only already be prepared in the factory beforehand so as to simplify assembly, but a possible transmission of noise between the pipeline and building is also prevented by this type of fastening.

Figure 6:
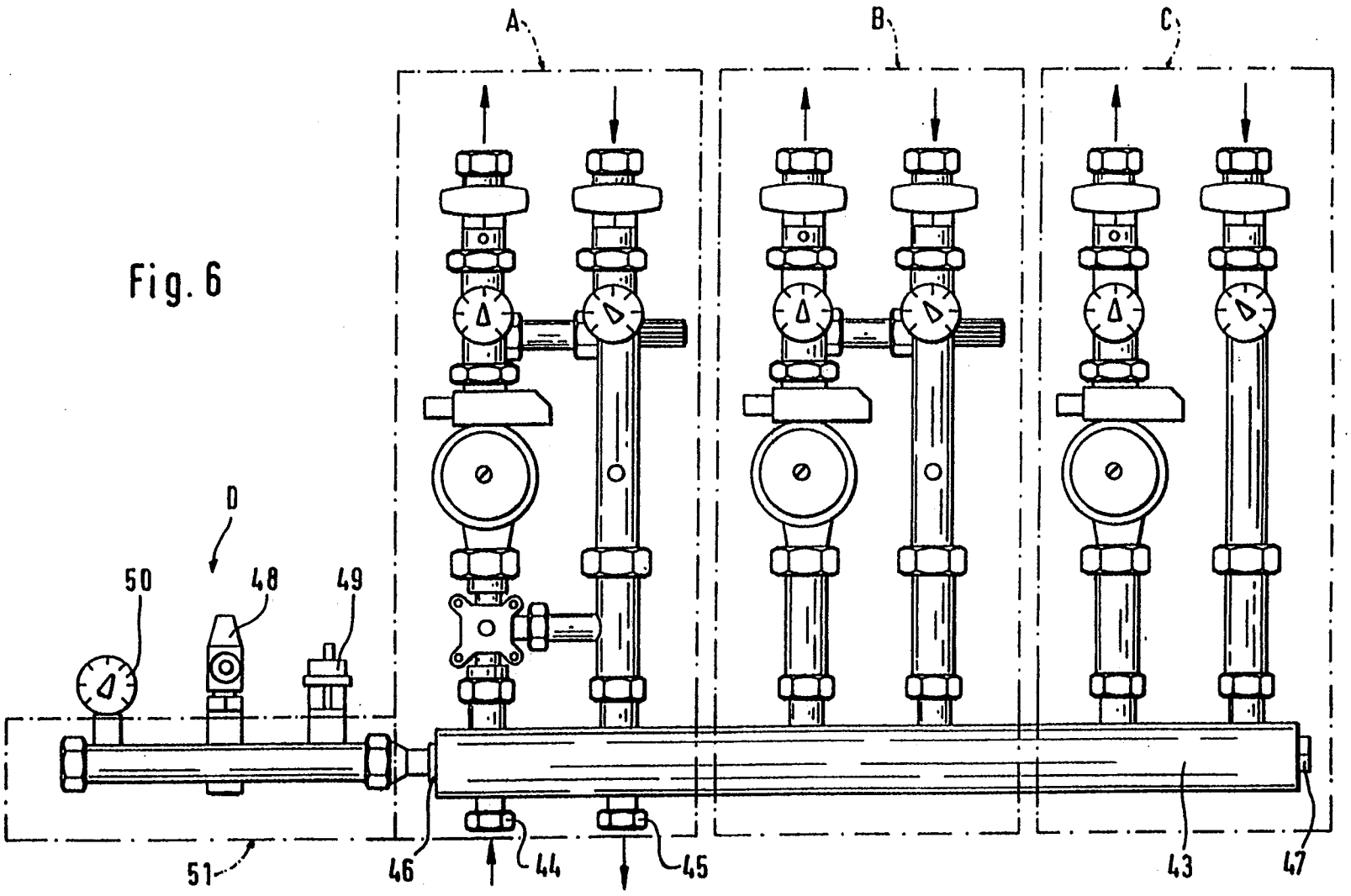
FIG. 6 is a schematic view of an example for a building block type arrangement of a plurality of component groups at a heating circuit distributor.

FIG. 6 shows how different structural component groups with their associated housings can be arranged side by side in the manner of building blocks for realizing different heating circuits. A structural component group A for a heating circuit with three-way mixers corresponding to that described with reference to FIGS. 1 and 2 is shown schematically. It is followed by a structural component group B without mixers for sliding heating circuit regulation via the boiler temperature such as can be used for floor heating, for example. This is followed, finally, by a so-called accumulator or storage charge group C for the connection of a temperature-regulated accumulator for preparing utility water. These three structural component groups A, B and C, which should be considered only as examples, are connected one after the other to a multiple heating circuit distributor 43 which in turn has a connection 44 for boiler forward flow and a connection 45 for boiler return flow. The forward and return flows to the individual circuits are indicated by arrows.

The heating circuit distributor 43 is constructed according to the two-chamber system. It has a connection 46 at the front for a safety group D and a connection 47 on the other side, e.g. for a pressure expansion tank, known per se. The safety group D includes a safety valve 48, a quick de-aerator 49, and a manometer 50 with shut-off. This safety group D is also enclosed by a thermal insulating sheathing 51 which can adjoin that of the structural component group A associated with it.

Figure 7:
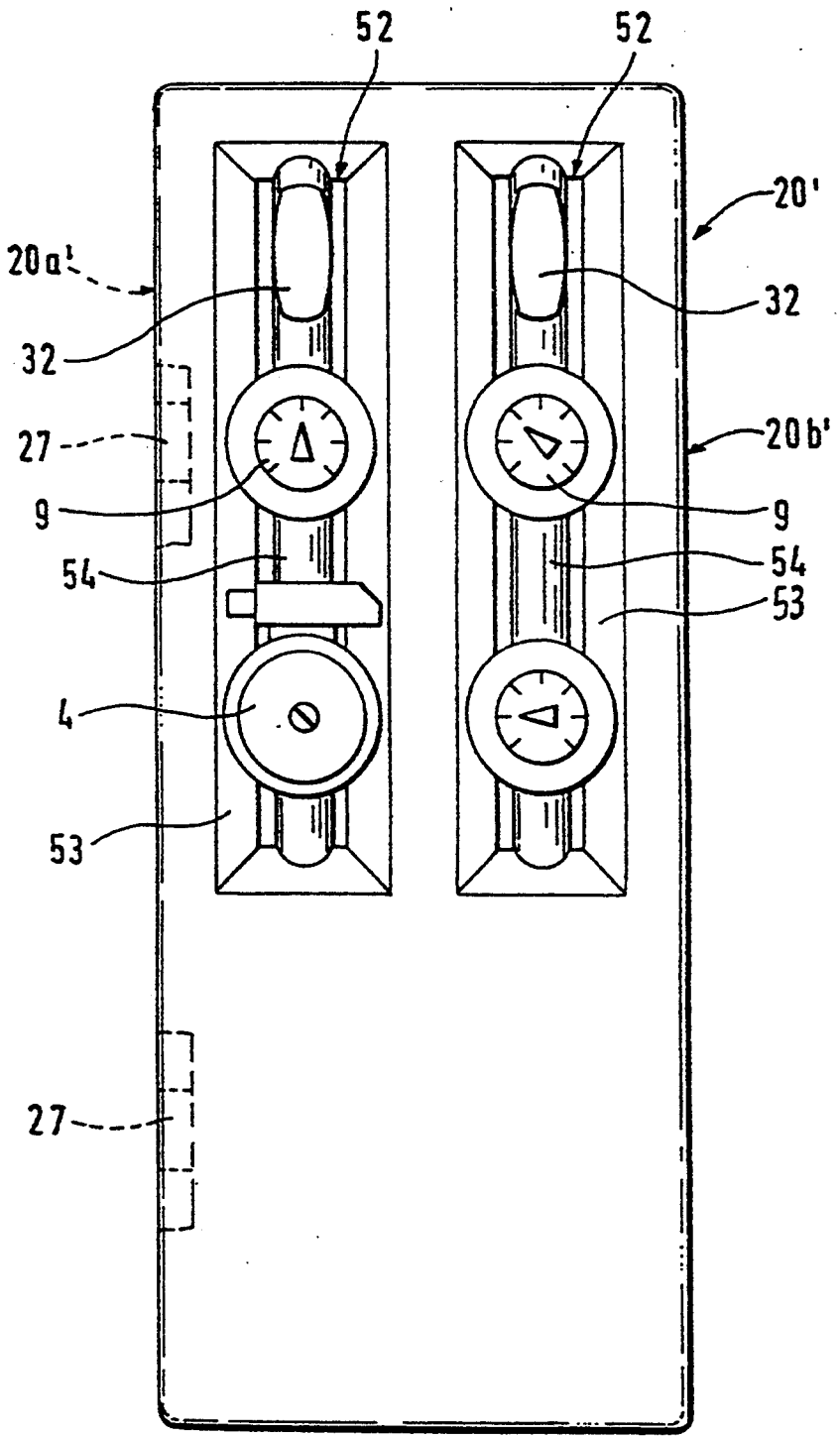
FIG. 7 shows a view of another embodiment of the housing.

Another embodiment of a housing according to the invention is shown in FIG. 7. In this construction, duct-like depressions 52, extending parallel to the pipelines, are provided in the upper shell 20*b*′ of the housing 20′ adjacent to the openings allowing the units, e.g. the pump housing 4 and the thermometers 9, to pass through. Due to these depressions 52, the outer part of the housing of the pump 4, for example, is freely accessible to the inlet of air without its front side needing to project beyond the surface of the upper shell 20*b*′. The duct-like construction of the depressions 52 extending in the vertical direction in addition to the oblique position of their walls makes it possible for the heat developing at the pump housing to be removed by convection.

Figure 8A:
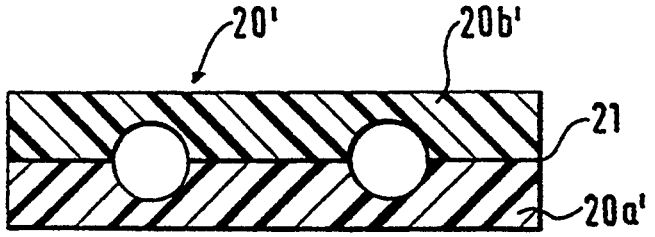
FIGS. 8*a* to 8*d* show schematic views of some cross sections through the housing according to FIG. 7.
Figure 8B:
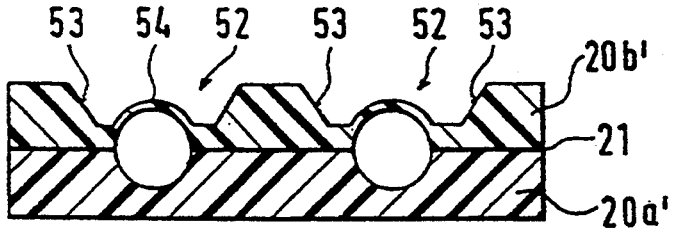

FIGS. 8*a* to *d* show some sections through the housing 20′ according to FIG. 7, and offer a better view of the construction of the duct-like depressions 52. FIG. 8*a* is a section in the normal region showing the box-like construction of the housing 20′. FIG. 8*b* is a section through the normal undisturbed region of the duct-like depression 52 which shows the oblique side walls 53 and the shell-like sheathing 54 of the pipelines. The lock-seam construction of the edges is omitted for the sake of clarity.

Figure 8C:
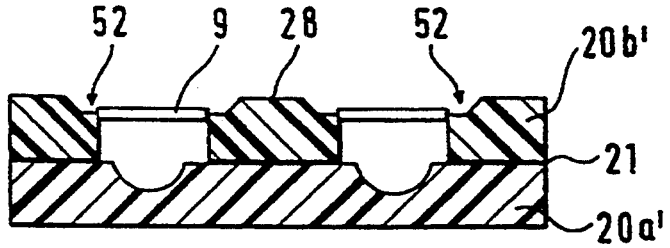
Figure 8D:
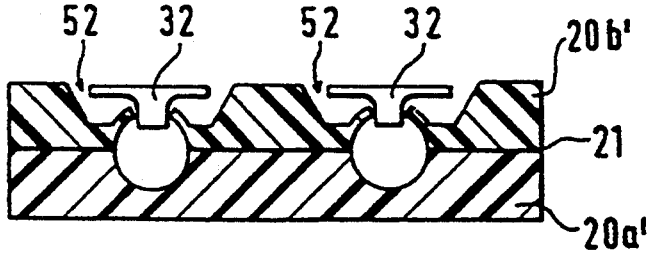

Finally, FIGS. 8*c* and 8*d* show sections through the region of the thermometers 9 and the valve handles 32 which are turned by 90 degrees to show how they are situated relative to the surface 28 of the upper shell 20*b*′.

While the invention has been illustrated and described as embodied in a device for supplying a circuit of a heating or cooling supply system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for supplying a circuit of a heating or cooling supply system, comprising: a structural component group made up of units for conveying a medium and for regulating and monitoring the medium, including fittings and connecting parts, that are combined in parallel pipelines for forward and return flow; a housing in which the structural component group is arranged so as to be ready for installation, the housing being made of a thermal insulating plastic material and divided into a lower shell and an upper shell by a seam that extends approximately in a central plane formed by the parallel pipelines; lock-seam connection means for connecting together the lower shell and the upper shell, the connection means including lock-seams that form a positive-locking connection along an outer edge of the upper and lower shells, the upper shell being provided with openings so as to permit selected components of the units to pass through the upper shell; and means for directly fastening the lower shell to a wall, the material of the lower shell and upper shell having a strength and thickness so that the housing is usable as a protective transportation package for the structural component group and as thermal insulating sheathing after installation.

2. A device according to claim 1, wherein the shells are made of a material having strength and elastic properties, the lock-seam connection means including a lock-seam strip with an undercut and a groove with an undercut, wherein each undercut strip has an angle and a height that are selected as a function of the strength and elastic properties of the material of which the lower and upper shells are made so that the lock-seam connection means is openable and closeable by exerting a force acting in a line normal to a surface of the housing.

3. A device according to claim 2, wherein the lock-seam strip is provided on the upper shell and the groove is provided at the lower shell.

4. A device according to claim 1, and further comprising centering means for centering the shells with one another, the centering means including at least two centering pins provided in an interior region of one of the shells so as to connect and fit in corresponding receptacles in the other of the shells.

5. A device according to claim 4, wherein the centering pins have a conical outer region.

6. A device according to claim 4, wherein the centering pins and the corresponding receptacles have profiles that enable a resilient positive locking.

7. A device according to claim 1, wherein the upper shell has at least one depression at its outer surface, which depression is arranged so as to at least partially free from the device units in a pipeline that generate heat.

8. A device according to claim 7, wherein the each depression is a duct that extends parallel to the pipeline having the units.

9. A device according to claim 8, wherein the each depression has side and end walls at least one of which extends obliquely relative to the outer surface of the upper shell.

10. A device according to claim 1, wherein the structural component group and the housing in which the component group is arranged are constructed so as to be connectable to a transversely extending tubular two-chamber heating circuit distributor.

11. A device according to claim 1, wherein the housing is made of polypropylene.

12. A device according to claim 1, wherein the housing is made of polyethylene.

* * * * *